US005659326A

United States Patent [19]

McWhirter et al.

[11] Patent Number: 5,659,326

[45] Date of Patent: Aug. 19, 1997

[54] THICK FLARED NOTCH RADIATOR ARRAY

[75] Inventors: Brian T. McWhirter, Citrus Heights; Steve K. Panaretos, Los Angeles; John Fraschilla, Redondo Beach; Lonny R. Walker, Torrance; Jay L. Edie, Playa del Rey, all of Calif.

[73] Assignee: Hughes Electronics, Los Angeles, Calif.

[21] Appl. No.: 656,593

[22] Filed: May 31, 1996

Related U.S. Application Data

[63] Continuation of Ser. No. 362,323, Dec. 22, 1994, abandoned.

[51] Int. Cl.[6] ..... H01Q 13/10

[52] U.S. Cl. ..... 343/770; 343/767

[58] Field of Search ..... 343/767, 768, 343/770, 841; H01R 13/10

[56] References Cited

U.S. PATENT DOCUMENTS

| | | | |
|---|---|---|---|
| 5,081,466 | 1/1992 | Bittor, Jr. | 343/767 |
| 5,187,489 | 2/1993 | Whelan et al. | 343/770 X |
| 5,220,330 | 6/1993 | Salvoil et al. | 343/786 X |
| 5,268,701 | 12/1993 | Smith | 343/767 |
| 5,311,199 | 5/1994 | Fraschilla et al. | 343/841 X |

*Primary Examiner*—Donald T. Hajec

*Assistant Examiner*—Tho Phan

*Attorney, Agent, or Firm*—Leonard A. Alkov; Wanda K. Denson-Low

[57] ABSTRACT

An array of thick flared notch radiators, wherein the separation distance between adjacent pairs of flared notch sticks is set to be less than one-half wavelength at the highest frequency of concern. The separation distance suppresses the propagation of higher order modes along the length of the sticks, which would degrade the array performance. The separation distance is achieved by fabricating the sticks with an increased thickness, thereby reducing the stick-to-stick channel width.

11 Claims, 6 Drawing Sheets

THICK FLARED NOTCH RADIATOR ARRAY

This is a continuation application Ser. No. 08/362.323, filed Dec. 22, 1994, now abandoned.

TECHNICAL FIELD OF THE INVENTION

The present invention relates to flared notch radiator elements useful in antenna arrays, and more particularly to a flared notch radiator having an increased thickness to suppress the excitation of higher order modes of electromagnetic energy that degrade RCS and radiation performance.

BACKGROUND OF THE INVENTION

Flared-notch radiators have been traditionally fabricated utilizing printed-circuit board technology. Variations in dielectric constant of the substrate materials used in the fabrication and their low structural strength made this fabrication technology unsuitable for many applications. Therefore, machined-metal flared-notches were developed as a solution to the problems inherent with printed-circuit board flared-notches.

It was discovered experimentally, during radar cross-section (RCS) testing of a flared-notch aperture, that higher order modes of electromagnetic energy are excited between the flared-notch sticks of the array at specific frequencies and propagate along the length of these sticks. Allowing these modes to exist and propagate presents two disadvantages. First, at the mode excitation frequency, large nulls appear in the embedded element pattern of the flared-notch aperture. These nulls will not allow the main beam of an antenna to scan to its designed scan limits thus limiting radar scan performance at higher frequencies. Second, when the energy propagating between the sticks reaches a discontinuity (such as the end of the sticks themselves), some of the energy scatters. This scattering will manifest itself as a resonance phenomena in radar cross section (RCS) measurements of a flared-notch aperture. This resonance phenomena must be eliminated for very-low RCS apertures.

It would therefore be advantageous to provide a flared notch radiator array that suppresses higher order mode excitation without impacting radiation characteristics or array gain.

SUMMARY OF THE INVENTION

An array of metal flared notch radiator elements is described which fulfills this need. The array comprises a plurality of metal sticks disposed in aligned rows, each stick defining a plurality of flared notches, with adjacent ones of the metal sticks separated by a separation distance so as to define a respective channel between each adjacent pair of sticks. Means are provided for suppressing higher order modes propagating between the sticks, comprising means for establishing the separation distance to be less than one-half wavelength at a highest frequency of concern for array. In a preferred implementation, the separation distance establishing means includes a thickened width of the sticks, thereby reducing the channel width.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
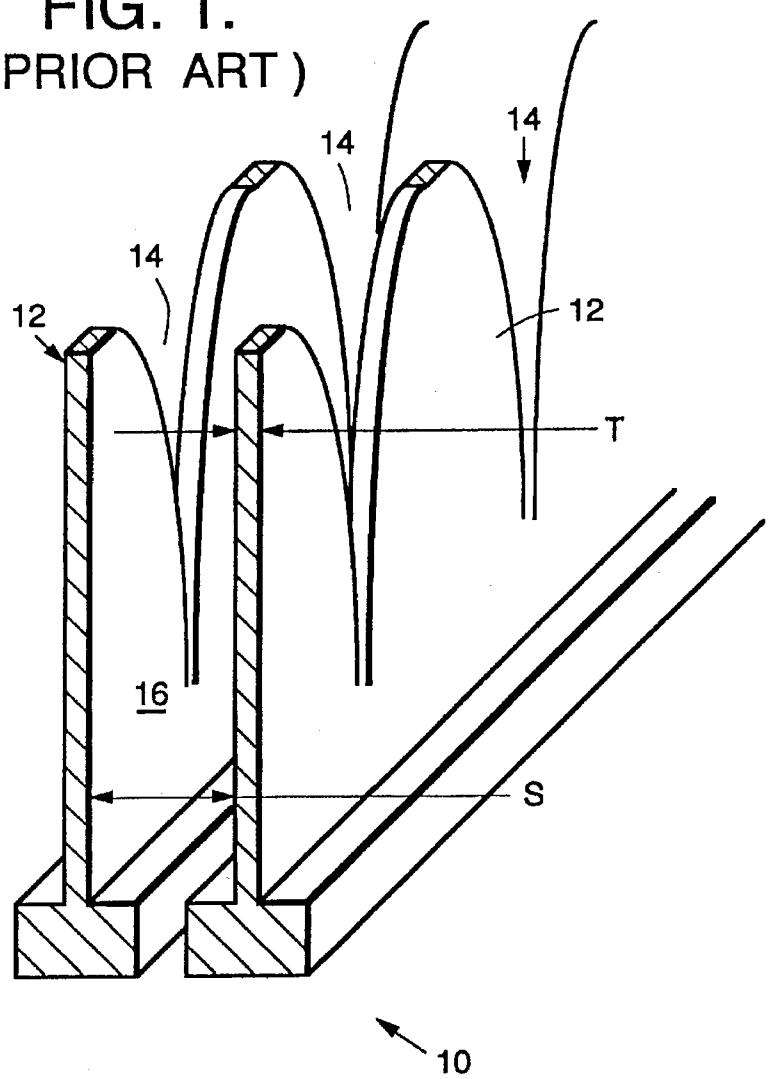
FIG. 1. (PRIOR ART)
FIG. 1 is a simplified isometric view of a portion of a conventional metal flared notch array.
Figure 3:
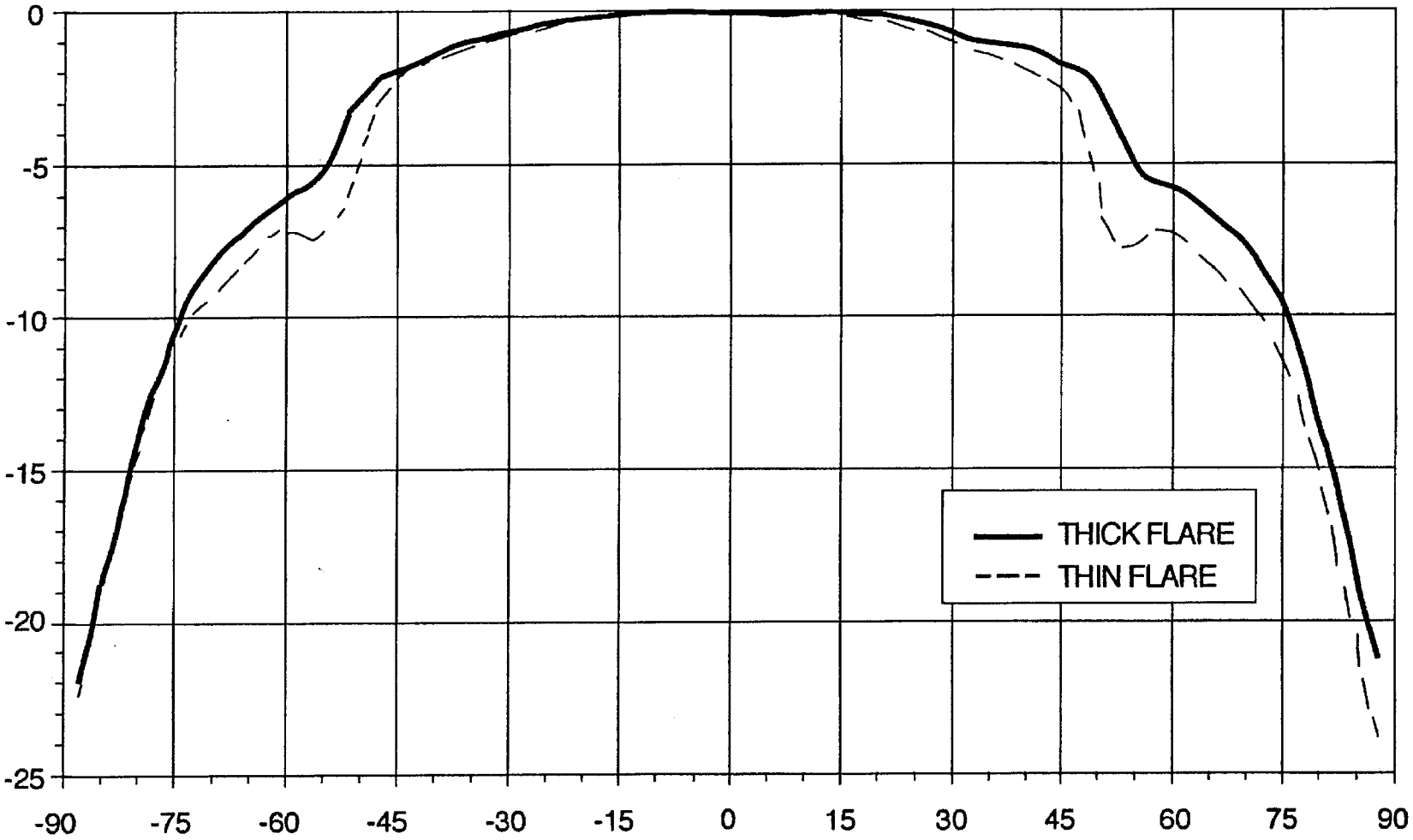
FIGS. 3–7 illustrate the embedded element patterns of the conventional array of FIG. 1 and superimposed thereon the corresponding patterns of the new array of FIG. 2, for five different frequencies.
Figure 4:
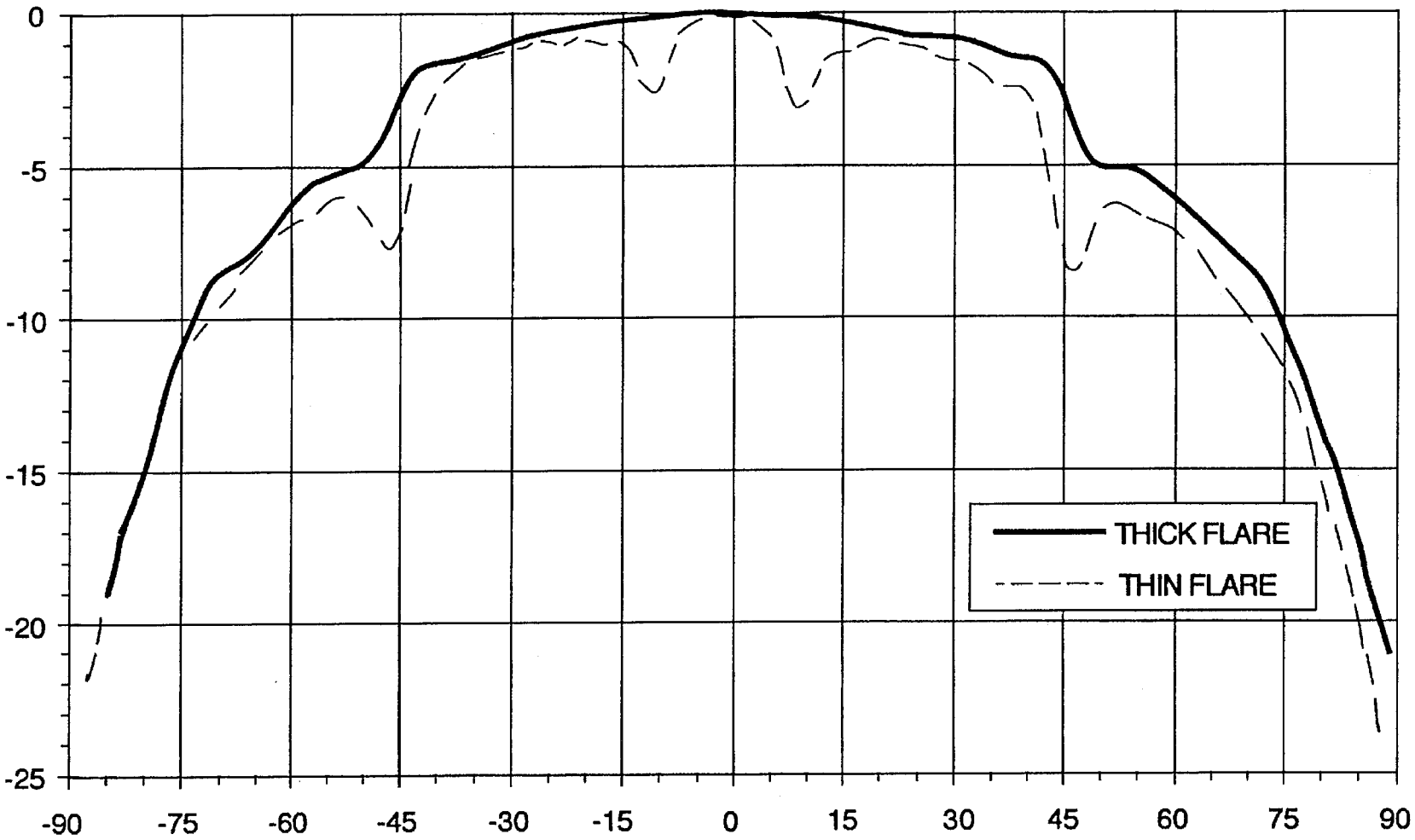
Figure 5:
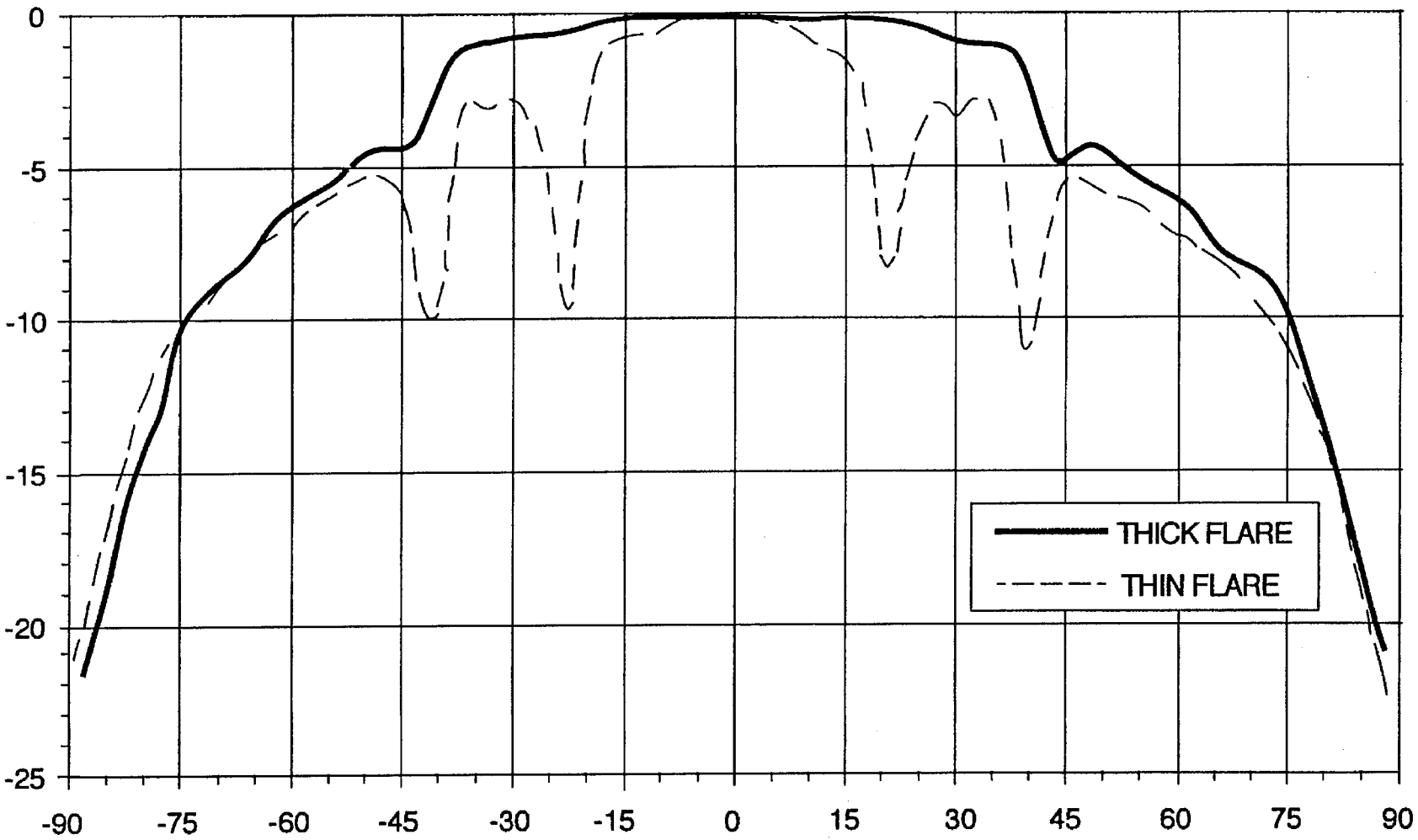
Figure 6:
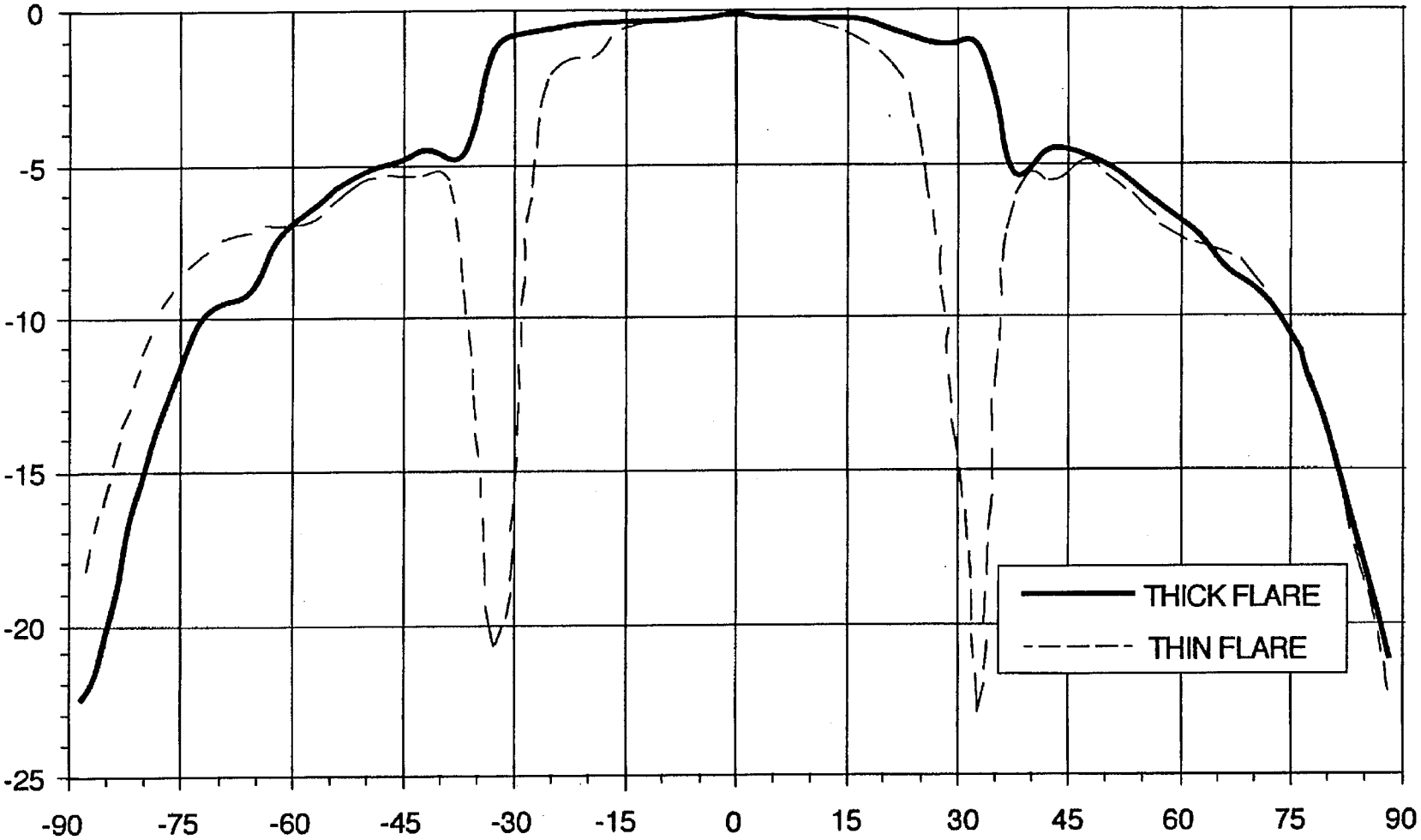
Figure 7:
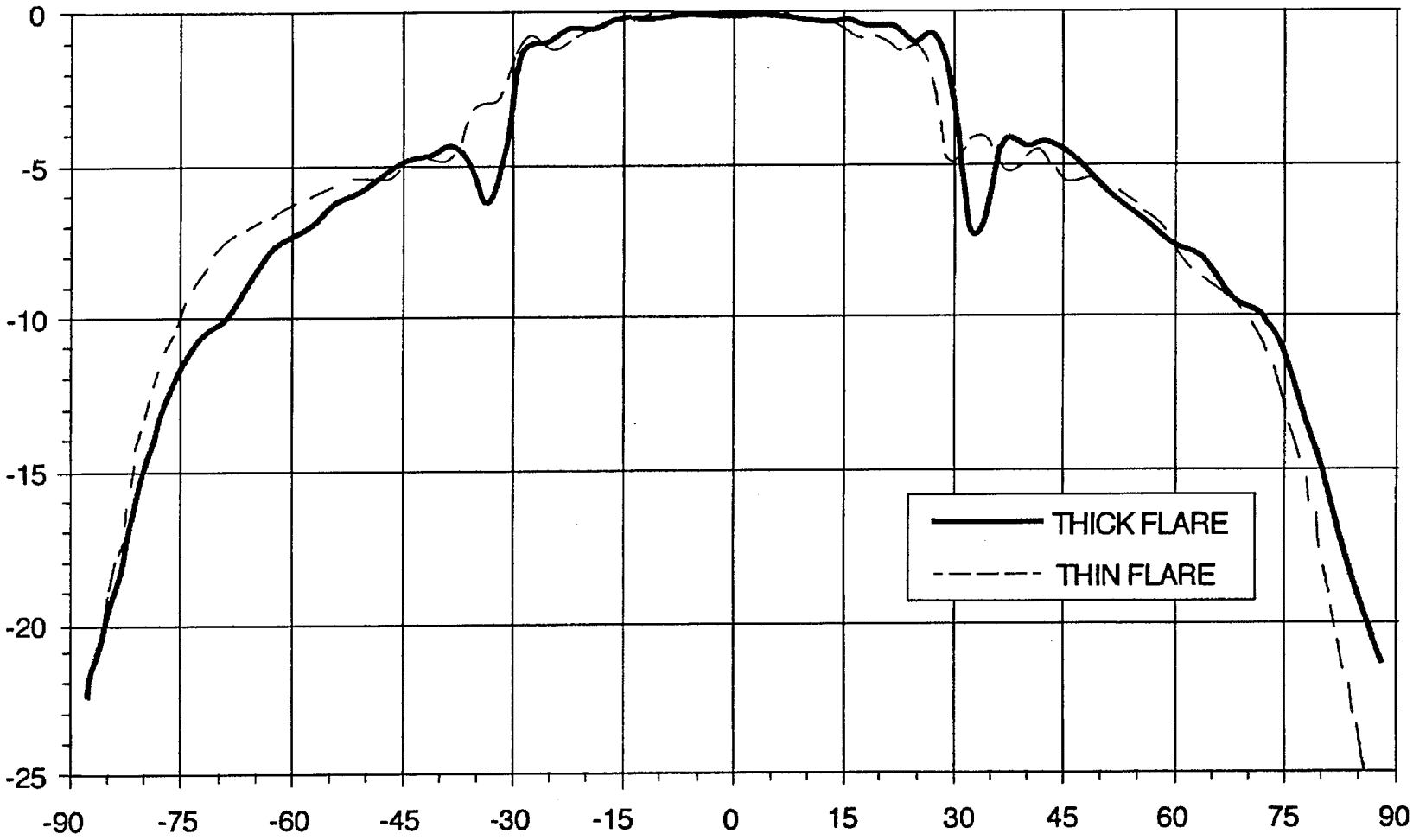

FIG. 1 illustrates a conventional metal flared notch array 10. The array includes a plurality of sticks 12, each fabricated of a metal such as aluminum, although many other metals are also suitable. Each stick 12 is fabricated to define a plurality of flared notches 14, which are excited by conventional feed circuits (not shown) to radiate energy. Typically the feed circuits include transmission lines (not shown) embedded in the sticks 12 and baluns (not shown) at the flared notches. In an exemplary application, the array 10 can be designed for operation over the 6–18 GHz frequency band, with the higher order modes excited at 13.5 GHz. The stick thickness T is 0.106 inches. The stick-to-stick separation S is 0.437 inches, which is one-half wavelength at 13.5 GHz. Thus, channels 16 are formed between adjacent pairs of the sticks. The separation distance S is the distance between the outer facing surfaces of the adjacent pairs of sticks 12 comprising the array 10.

The flared notch array 10 suffers the problem noted above that higher order modes of electromagnetic energy are excited between the flared notch sticks 10 at certain frequencies. This problem is solved by the flared notch configuration of the array 20 illustrated in FIG. 2. In accordance with the invention, the stick-to-stick separation of the array 20 is selected to be less than one-half wavelength at the highest frequency of concern. This separation is found to suppress scattering modes, without impacting the radiation characteristics of the array. The highest frequency of concern implies either the highest frequency for which suppression of the radar cross section (RCS) of the antenna is necessary (18 GHz, for this particular example), or the highest operating frequency that the antenna will transmit or receive RF signals (also 18 GHz for this particular example).

Figure 2:
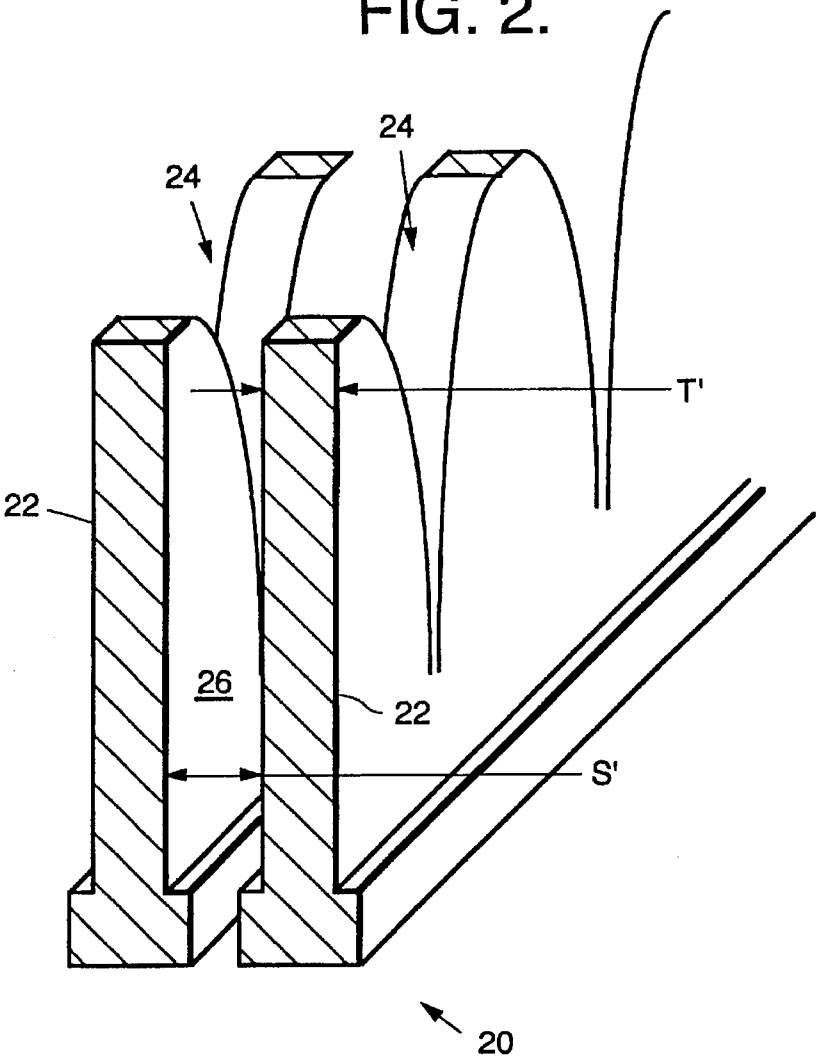
FIG. 2 is a simplified isometric view of a portion of a metal flared notch array embodying the invention.

FIG. 2 illustrates an exemplary array, useful for the same applications as the conventional array 10 of FIG. 1. The design of the conventional flared-notch stick 12 of FIG. 1 is modified by increasing the stick width to 0.210 inches thereby reducing the stick-to-stick separation to 0.328 inches. Thus, in the array 20, the sticks 22 have a thickness T' of 3.210 inches, and a stick-to-stick separation S' of 0.3238 inches; this separation distance is the width of the channels 26. The separation distance S' is set equal to one-half wavelength at 18.1 GHz. In this particular example, the separation distance S' is selected based on a frequency slightly above the highest frequency of concern, 18 GHz, to provide some design margin.

The second parallel-plate mode is excited when the frequency is such that the stick-to-stick separation is one-half wavelength. Therefore, the higher order mode propagation would manifest itself at 13.5 GHz for the conventional sticks 12, and at 18.1 GHz for the thickened sticks 22.

Suppression of the higher order modes could be achieved by placing the sticks closer together, without increasing the stick thickness, to obtain the desired maximum stick-to-stick spacing. While such a configuration is within the scope of this invention, there are disadvantages to this embodiment. Given a fixed aperture area that must be populated by radiators, the objective is to use the least number of radiators, thus minimizing cost. If the sticks were simply moved closer together without increasing the stick thickness, the number of sticks required to populate the aperture would increase as would the quantity of all the components behind the antenna aperture. The growth in the number of components is manifested in the increased costs to design, fabricate, and test any design that utilizes this approach. The embodiment of FIG. 2 with its thick sticks eliminates the higher order modes (to the highest frequency of concern) without having an impact on the quantity or complexity of any of the antenna subassemblies or components, except for the increased thickness of the flared notch sticks.

The embedded element patterns of both arrays 10 and 20 were measured at several frequencies within an operating range. FIGS. 3–7 illustrate the formation of nulls in the pattern of the conventional array of FIG. 1, with the corresponding patterns of the array 20 superimposed thereon. Noteworthy is the absence of nulls for the new array 20. Moreover, it is seen that the array 20 is well behaved past the frequency where the conventional array 10 begins to degrade.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An array of metal flared notch radiator elements, comprising a plurality of metal sticks disposed in aligned upright rows which are perpendicular to a common plane, each stick defining a plurality of flared notches, adjacent ones of said metal sticks being separated by a separation distance so as to define a respective channel between each adjacent pair of sticks, said separation distance representing a channel width which is a shortest distance between adjacent aligned surfaces of said pair of sticks, and means for suppressing the excitation of second and higher order parallel-plate modes propagating between said sticks, said means comprising means for establishing said separation distance to be less than one-half wavelength at a highest frequency of concern for said array, so that said separation distance is less than the distance necessary for excitation of said second and higher order parallel-plate modes.

2. The array of claim 1 wherein said array operates over a frequency band between 6 and 18 GHz, and said highest frequency of concern for said array is at least 18 Ghz.

3. The array of claim 2 wherein said separation distance is less than 0.33 inches.

4. In an array of thick metal flared notch radiator elements disposed over a fixed aperture area populated by said radiator elements, comprising a predetermined number of thick metal sticks disposed in aligned rows, each stick defining a predetermined number of flared notch radiating elements, adjacent ones of said metal sticks being separated by a separation distance so as to define a respective channel between each adjacent pair of sticks, said separation distance representing a channel width which is a shortest distance between adjacent aligned surfaces of said pair of sticks, means for suppressing the excitation of second and higher order parallel-plate modes propagating between said sticks, said means comprising means for establishing said separation distance to be less than one-half wavelength at a highest frequency of concern for said array without increasing the number of sticks comprising said array, so that said separation distance is less than the distance necessary for excitation of said second and higher order parallel-plate modes.

5. The invention of claim 4 wherein said means for establishing said separation distance without increasing said number of sticks comprises a thickness of said sticks, wherein an increase in thickness of said sticks results in a reduction in said channel separation distance.

6. The array of claim 5 wherein said array operates over a frequency band between 6 and 18 GHz, and said highest frequency of concern for said array is at least 18 Ghz.

7. The array of claim 6 wherein said separation distance is less than 0.33 inches.

8. The array of claim 6 wherein said stick thickness is about 0.21 inches.

9. The invention of claim 4 wherein said sticks are upright and perpendicular to a common plane.

10. A method for fabricating an array of metal flared notch radiator elements, comprising the following steps:

providing a plurality of metal sticks, each stick defining a plurality of flared notches;

arranging said metal sticks in a plurality of aligned upright rows which are perpendicular to a common plane, adjacent ones of said metal sticks being separated by a separation distance so as to define a respective channel between each adjacent pair of sticks, said separation distance representing a channel width which is a shortest distance between adjacent aligned surfaces of said pair of sticks,; and establishing said separation distance to be less than one-half wavelength at a highest frequency of concern for said array, so that said separation distance is less than the distance necessary for excitation of second and higher order parallel-plate modes, thereby suppressing the excitation of said second and higher order parallel plate modes from propagating between said sticks.

11. The method of claim 10 wherein said array of radiating elements populates a predetermined aperture area with a predetermined number of sticks, and wherein said separation distance is established without requiring an increase in said predetermined number of sticks, through a selection in a thickness dimension of said sticks.

* * * * *